US010717281B2

(12) United States Patent
Kinokuni

(10) Patent No.: US 10,717,281 B2
(45) Date of Patent: Jul. 21, 2020

(54) HEAD MODULE AND LIQUID DISCHARGE APPARATUS

(71) Applicant: Takashi Kinokuni, Tokyo (JP)

(72) Inventor: Takashi Kinokuni, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/275,428

(22) Filed: Feb. 14, 2019

(65) Prior Publication Data

US 2019/0283416 A1 Sep. 19, 2019

(30) Foreign Application Priority Data

Mar. 16, 2018 (JP) ..... 2018-048879
Nov. 30, 2018 (JP) ..... 2018-224700

(51) Int. Cl.
*B41J 2/14* (2006.01)
*B41J 2/16* (2006.01)
*B41J 2/15* (2006.01)
*B41J 2/155* (2006.01)

(52) U.S. Cl.
CPC ..... *B41J 2/1433* (2013.01); *B41J 2/15* (2013.01); *B41J 2/155* (2013.01); *B41J 2/162* (2013.01); *B41J 2/1623* (2013.01); *B41J 2202/19* (2013.01); *B41J 2202/20* (2013.01)

(58) Field of Classification Search
CPC ..... B41J 2/145; B41J 2/15; B41J 2/155; B41J 2/17503; B41J 2/2103; B41J 3/54; B41J 3/60; B41J 3/543; B41J 2102/20
See application file for complete search history.

(56) References Cited

U.S. PATENT DOCUMENTS

2007/0026561 A1* 2/2007 Kamei ..... B41J 2/1623
2008/0284826 A1* 11/2008 Owaki et al. ..... 347/71
2013/0021412 A1 1/2013 Nishimura et al.

FOREIGN PATENT DOCUMENTS

JP 2005-014454 2/2005
JP 2007-296638 11/2007
JP 2013-022848 2/2013
JP 2013-144390 7/2013
JP 2013-256077 12/2013

* cited by examiner

*Primary Examiner* — Juanita D Jackson

(74) *Attorney, Agent, or Firm* — Harness, Dickey and Pierce, P.LC.

(57) ABSTRACT

A head module includes a base including a plurality of openings, and a plurality of heads inserted into the plurality of openings, respectively, to be mounted on the base. The plurality of heads includes a nozzle plate including a nozzle, an individual channel member disposed on the nozzle plate and including an individual chamber communicating with the nozzle, and a frame fixed to the individual channel member. Coefficients of linear expansion of the nozzle plate and the individual channel member are substantially identical to a coefficient of linear expansion of the base, and one of the nozzle plate and the individual channel member is bonded to the base.

14 Claims, 11 Drawing Sheets

HEAD MODULE AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-048879, filed on Mar. 16, 2018, and Japanese Patent Application No. 2018-224700, filed on Nov. 30, 2018, in the Japan Patent Office, the entire disclosure of each of which is hereby incorporated by reference herein.

BACKGROUND

Technical Field

Embodiments of the present disclosure relate to a head module and a liquid discharge apparatus.

Related Art

A plurality of liquid discharge heads is attached to a base to form a head module (also referred to as a head unit, a head array, or the like).

In particular, some liquid discharge heads have a configuration in which a plurality of recording element substrates is arranged in a staggered manner on a main surface of a first plate having a coefficient of linear expansion equivalent to a coefficient of linear expansion of a ceramic material or a recording element substrate.

SUMMARY

In an aspect of this disclosure, a novel head module includes a base including a plurality of openings and a plurality of heads inserted into the plurality of openings, respectively, to be mounted on the base. The plurality of heads includes a nozzle plate including a nozzle, an individual channel member disposed on the nozzle plate, and a frame fixed to the individual channel member. The individual channel member includes an individual chamber communicating with the nozzle. Coefficients of linear expansion of the nozzle plate and the individual channel member are substantially identical to a coefficient of linear expansion of the base. One of the nozzle plate and the individual channel member is bonded to the base.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
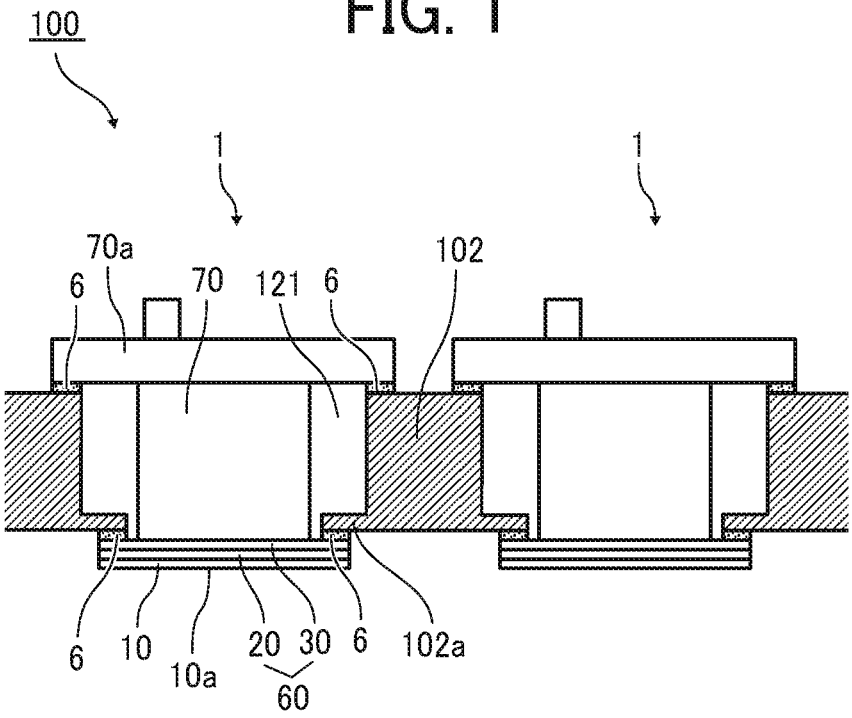
FIG. 1 is a cross-sectional view of a portion of a head module according to a first embodiment in a longitudinal direction of a liquid discharge head.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

Embodiments of the present disclosure are described below with reference to the attached drawings. In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise. Similarly, the terms "image formation", "recording", "printing", "image printing", and "fabricating" used herein may be used synonymously with each other.

Figure 2:
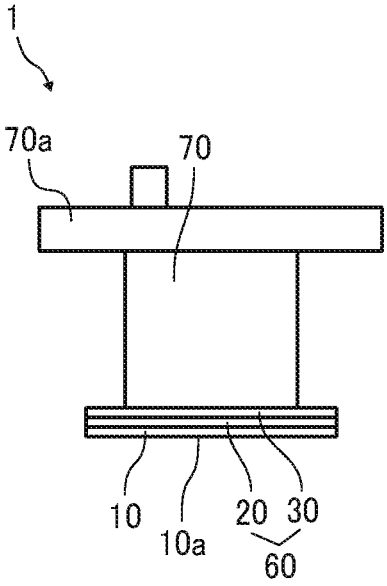
FIG. 2 is a cross-sectional view of an example of the liquid discharge head of the head module.

A first embodiment of the present disclosure is described with reference to FIGS. 1 and 2. FIG. 1 is a cross-sectional view of a portion of a head module 100 according to the first embodiment in a longitudinal direction of the liquid discharge head 1. FIG. 2 is a cross-sectional view of an example of the liquid discharge head 1.

The head module 100 includes a plurality of liquid discharge heads 1 to discharge a liquid and a base 102 into which the heads 1 are fitted. Hereinafter, the "liquid discharge head" is simply referred to as a "head".

Each of the plurality of heads 1 includes a nozzle plate 10, an individual channel member 60 (actuator substrate), and a common channel member 70. The nozzle plate 10 includes nozzles 11 (see FIG. 10) in the nozzle plate 10. The individual channel member 60 includes an individual channel plate 20 forming individual chambers communicating with the nozzles 11, respectively, and a diaphragm 30 including a piezoelectric element, in one body. The common channel member 70 forms a common channel.

The common channel member 70 also serves as a frame of the head 1. The common channel member 70 of the head 1 includes flanges 70*a* at both end portions in a direction of arrangement of the heads 1. The common channel member 70 (frame) is fixed (bonded) to the individual channel member 60.

The base 102 includes a plurality of openings 121 into which the heads 1 are fitted, respectively. The base further includes flanges 102*a* that protrude inward around the opening 121 in a nozzle surface 10*a* (surface of a nozzle plate 10) side of the head 1.

Each of the heads 1 is fitted into the opening 121 of the base 102. The diaphragm 30 side (frame side) of the individual channel member 60 facing the common channel member 70 (frame) and the flange 102*a* of the base 102 are bonded with an adhesive 6.

Thus, the individual channel member 60 facing the frame (common channel member 70) is bonded to the base 102.

The flange 70*a* of the common channel member 70 serving as the frame is also bonded and fixed to the surface of the base 102 opposite to the nozzle surface 10*a* side with the adhesive 6.

Here, coefficients of linear expansion of the nozzle plate 10 and the individual channel member 60 are substantially equal (identical) to a coefficient of linear expansion of the base 102. More specifically, a difference (a−b) between the coefficient of linear expansion "a" of the nozzle plate 10 and the individual channel member 60 and the coefficient of linear expansion "b" of the base 102 is within 25% of the coefficient of linear expansion of the nozzle plate 10 and the individual channel member 60.

In the present embodiment, when the difference (a−b) is within a range of 25% of the coefficient of linear expansion of the nozzle plate 10 and the individual channel member 60, the coefficients of linear expansion of the nozzle plate 10 and the individual channel member 60 are said to be "substantially identical" to the coefficient of linear expansion of the base 102.

In the present embodiment, a ratio of "(a−b)/a" is calculated, and whether the ratio of "(a−b)/a" is within 25% is evaluated to determine whether the coefficients of linear expansion of the nozzle plate 10 and the individual channel member 60 are substantially equal (identical) to the coefficient of linear expansion of the base 102. Preferably, the difference (a−b) between the coefficient of linear expansion "a" and the coefficient of linear expansion "b" is within 15% of the coefficient of linear expansion "a".

Conversely, the common channel member 70 serving as a frame and the base 102 have different coefficients of linear expansion. For example, the nozzle plate 10 and the individual channel member 60 are formed of a silicon single-crystal substrate, and the common channel member 70 (frame) is formed of a thermoplastic resin. Conversely, the base 102 is formed of alloy 42, the main components of which are Fe and Ni, or of Invar or the like. The silicon single-crystal substrate has a coefficient of linear expansion of about 3.4 ppm. Invar has a coefficient of linear expansion of about 3.0 ppm. Alloy 42 has a coefficient of linear expansion of about 4.2 ppm.

Here, the coefficients of linear expansion "a" of the nozzle plate 10 and the individual channel member 60 formed of the silicon single-crystal substrate is 3.4 (a=3.4). When the base 102 is formed of Invar, the coefficient of linear expansion "b" of the base 102 is 3.0 (b=3.0). Thus, the ratio "(a−b)/a" becomes, (a−b)/a=(3.4−3.0)/3.4=0.12 Further, when the base 102 is formed of alloy 42, the ratio "(a−b)/a" becomes (3.4−4.2)/3.4=0.24 since the coefficient of linear expansion "b" is 4.2 (b=4.2).

Thus, the coefficient of linear expansion of the base 102 becomes substantially identical to the coefficients of linear expansion of the nozzle plate 10 and the individual channel member 60 formed of the silicon single-crystal substrate. That is, the nozzle plate 10, the individual channel member 60, and the base 102 has an identical coefficient of linear expansion. Thus, expansions of the base 102, the nozzle plate 10, and the individual channel member 60 due to temperature changes hardly occur. Particularly, since the coefficients of linear expansion of Invar material and silicon single-crystal substrate are close, it is preferable to form the base 102 with Invar.

Conversely, the coefficient of linear expansion of the common channel member 70 is larger than the coefficient of linear expansion of the base 102. Thus, an expansion of the common channel member 70 becomes relatively larger than an expansion of the base 102 or expansions of the nozzle plate 10 and the individual channel member 60 according to temperature.

As described above, the base 102 and the individual channel member 60 having small thermal expansions are bonded to each other. Thus, the head 1 according to the present embodiment can reduce a displacement of relative positions between positions of the nozzles 11 of the nozzle plate 10 of one head 1 with positions of the nozzles of the nozzle plate 10 of another head 1 even when a temperature change or the like occurs. FIGS. 3A-3D are cross-sectional views of the head 1 illustrating a state of deformation of each part of the head 1 caused by the difference in coefficient of linear expansion of each part of the head 1.

Figure 3A:
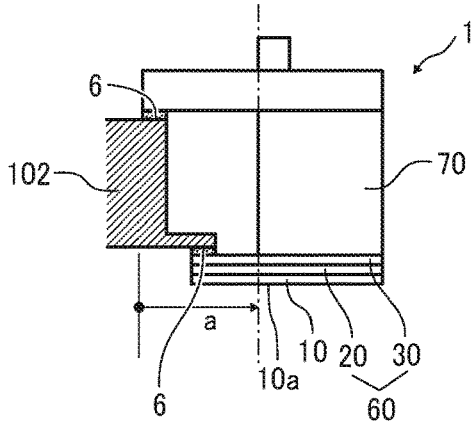
FIGS. 3A to 3D are cross-sectional views of the head module in a state of deformation of each part of the head module.

FIG. 3A illustrates a configuration of the present embodiment in which the base 102 and the individual channel member 60 are bonded, and the base 102 and the common channel member 70 as the frame are bonded.

Figure 3B:
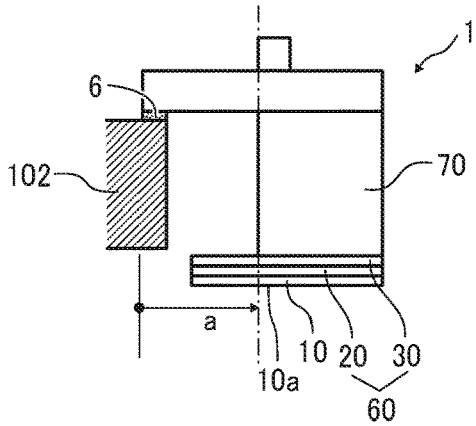

FIG. 3B illustrates a configuration of Comparative Example 1 in which the base 102 and the common channel member 70 as the frame are bonded.

Figure 3C:
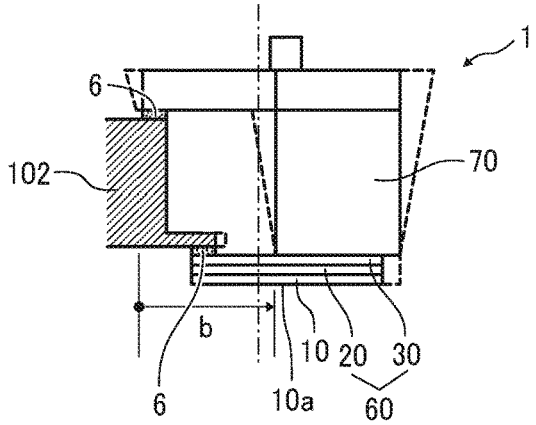

FIG. 3C illustrates the deformation of each part of the head 1 in the present embodiment when the temperature rises, indicated by a broken line.

Figure 3D:
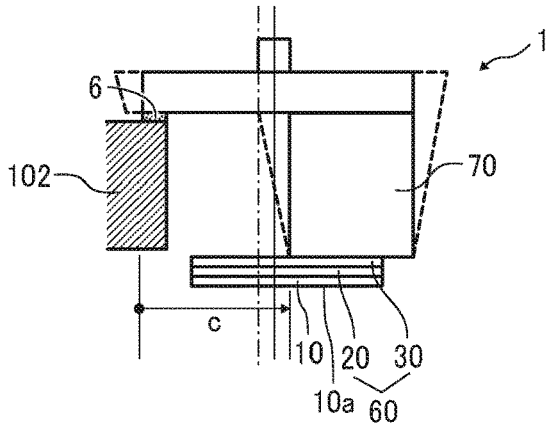

FIG. 3D illustrates the deformation of each part of the head 1 in the Comparative Example 1 when the temperature rises, indicated by a broken line.

In all cases, the deformation of the head 1 is larger on a side of the common channel member 70 (upper side in FIGS. 3C and 3D) and is smaller on a side of the individual channel member 60 and the nozzle plate 10 (lower side in FIGS. 3C and 3D).

Since a boundary portion between the common channel member 70 and the individual channel member 60 is bonded, an amount of deformation of the boundary portion becomes an intermediate amount between an amount of deformation of the side of the common channel member 70 and an amount of deformation of the side of the individual channel member 60 and the nozzle plate 10.

In FIGS. 3A and 3C in the configuration of the present embodiment, the base 102 is bonded to the common channel member 70 and the individual channel member 60. Thus, the parts each having a small coefficient of linear expansion are also bonded with each other.

Therefore, in the present embodiment, an amount of displacement of the nozzle position due to a status change from a state illustrated in FIG. 3A before the temperature rise to a state illustrated in FIG. 3C after the temperature rise becomes a difference (b−a) between the length "a" and the length "b".

Conversely, in the configuration of Comparative Example 1, the base 102 is bonded only to the common channel member 70.

Therefore, in Comparative Example 1, an amount of the displacement of the nozzle position due to a status change from a state illustrated in FIG. 3B before the temperature rise to a state illustrated in FIG. 3D after the temperature rise becomes a difference (c−a) between the lengths "a" and "c".

Here, the amount of displacement (b−a) of the nozzle position in the present embodiment is smaller than the amount of displacement (c−a) of the nozzle position in Comparative Example 1.

The base 102 is also deformed as illustrated by broken lines in FIGS. 3B and 3D. Since the coefficient of linear expansion of the base 102 is substantially identical to the coefficient of linear expansion of the individual channel member 60, the parts of both of the base 102 and the individual channel member 60 deform in the same way. Therefore, the displacement of the nozzle position with reference to the base 102 is small.

In FIGS. 3B and 3D, the base 102 and the flange 70*a* of the common channel member 70 of the head 1 are bonded at both ends in the longitudinal direction of the head 1. However, in FIGS. 3B and 3D, the individual channel member 60 and the base 102 are not bonded with each other.

Further, the base 102 and the head 1 may be bonded at both ends of the head 1 in a transverse direction of the head 1. Further, the base 102 and the head 1 may be bonded at both ends of the head 1 in both of the longitudinal direction and the transverse direction of the head 1.

Further, the head 1 may be pressurized when the nozzle surface 10*a* is capped, when the head 1 is connected with a tube, for example. Thus, as illustrated in FIGS. 3A and 3C in the present embodiment, not only the individual channel member 60 and the base 102 are bonded with each other, the common channel member 70 and the base 102 are also fixed (bonded) to each other. Thus, the head 1 in the present embodiment has an improved resistance to load and vibration stress compared with the head 1 in Comparative Example 1.

Figure 4:
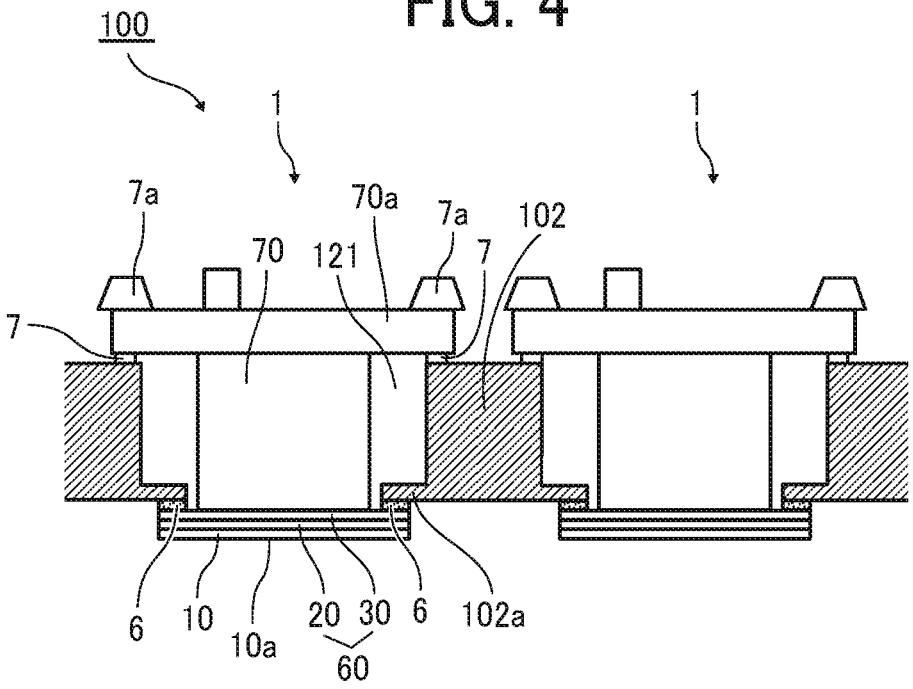
FIG. 4 is a cross-sectional view of a portion of the head module according to a second embodiment in the longitudinal direction of the liquid discharge head.
Figure 5:
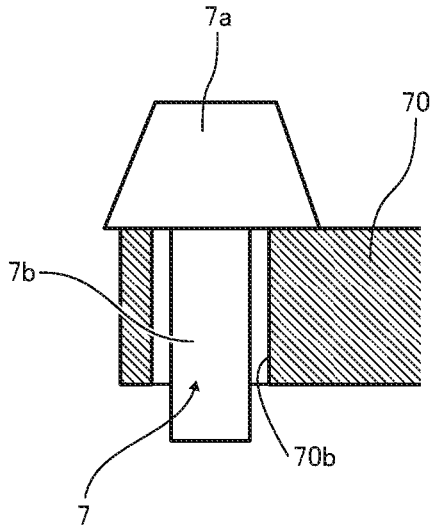
FIG. 5 is an enlarged cross-sectional view of a fixing portion between a frame and a common channel member.

Next, a second embodiment of the present embodiment is described with reference to FIGS. 4 and 5. FIG. 4 is a cross-sectional view of a portion of a head module 100 according to the second embodiment in a longitudinal direction of the head 1. FIG. 5 is an enlarged cross-sectional view of a fixed portion between the frame and the common channel member 70.

In the second embodiment, the base 102 and the individual channel member 60 are bonded with adhesive 6. The base 102 and the common channel member 70 (frame) are crimped by a resin pin 7 fixed to the base 102 to fix the common channel member 70 to the base 102.

The resin pin 7 is made of a thermoplastic resin. A process of crimping the common channel member 70 to the base 102 is completed by crushing a tip end of the resin pin 7 in a state in which the tip end of the resin pin 7 is heated. Here, a crimped portion 7*a* of the resin pin 7 deforms according to a plane of the common channel member 70. A gap exists between a hole 70*b* and a shaft 7*b* of the resin pin 7 since the shaft 7*b* of the resin pin 7 is smaller than a diameter of the hole 70*b* of the common channel member 70. Thus, only the tip end of the resin pin 7 is heated so that the shaft 7*b* of the resin pin 7 does not fill the hole 70*b* of the common channel member 70.

With the configuration illustrated in FIGS. 4 and 5, the common channel member 70 (frame) is relatively movable against the base 102 with the gap between sides of the hole 70*b* in the base 102 and the shaft 7*b* of the resin pin 7 when the resin pin 7 is inserted through the hole 70*b* in the base 102. Thus, the head 1 of the second embodiment can absorb deformation of the common channel member 70 in the longitudinal direction of the common channel member 70 in which a deformation due to heat is relatively large. Thus, the head 1 of the second embodiment can reduce the displacement of the nozzle position.

Further, the head 1 of the second embodiment fixes the common channel member 70 to the base 102 with crimping to improve resistance of the head 1 to load and vibration stress further.

Figure 6:
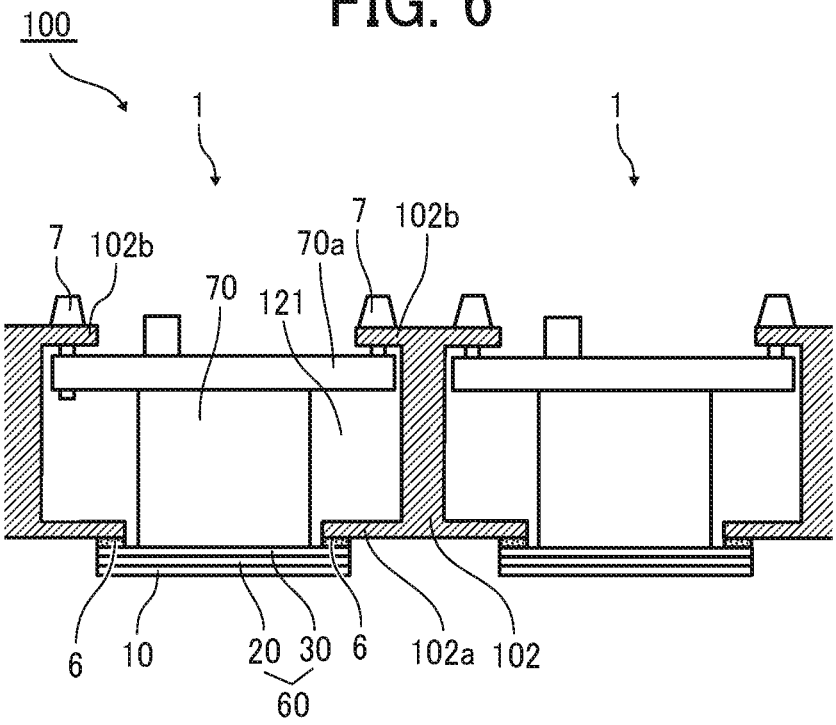
FIG. 6 is a cross-sectional view of a portion of the head module according to a third embodiment in the longitudinal direction of the liquid discharge head.

Next, a third embodiment of the present disclosure is described with reference to FIG. 6. FIG. 6 is a cross-sectional view of a main portion along a longitudinal direction of the head 1 of the head module 100 according to the third embodiment.

In the present embodiment, the resin pin 7 is fixed to the common channel member 70 serving as the frame of the head 1. The base 102 includes a flange 102*b*. The resin pin 7 is passed (inserted) through a hole formed in the flange 102*b* and fixed to the flange 102*b* of the base 102 by crimping to fix the common channel member 70 of head 1 to the flange 102*b* of the base 102.

Thus, the resin pin 7 provided in the common channel member 70 molded with resin (thermoplastic resin, for example) can reduce cost and assembling process of the head 1.

Figure 7:
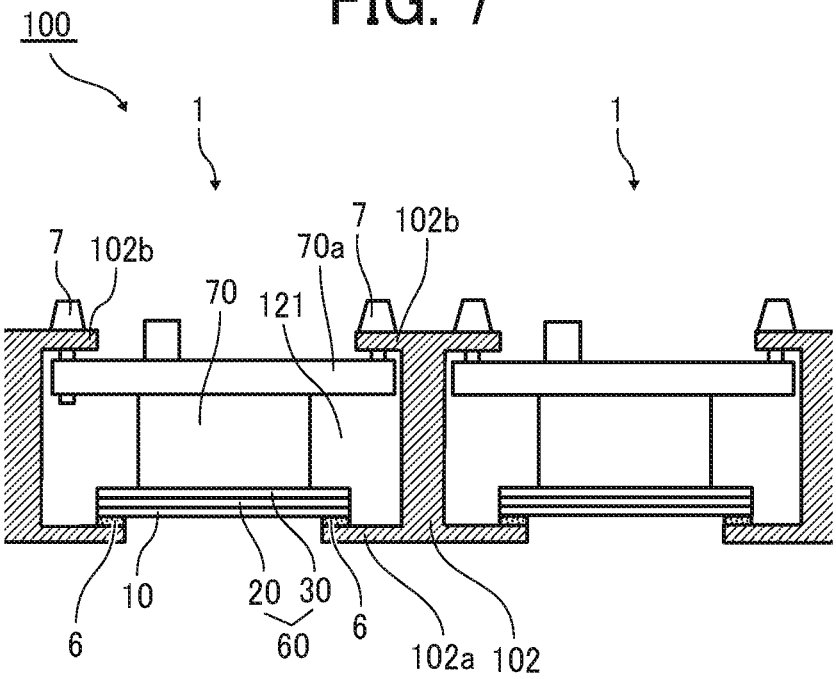
FIG. 7 is a cross-sectional view of a portion of the head module according to a fourth embodiment in the longitudinal direction of the liquid discharge head.

Next, a fourth embodiment of the present disclosure is described below with reference to FIG. 7. FIG. 7 is a cross-sectional view of a main portion along a longitudinal direction of the head 1 of the head module 100 according to the fourth embodiment.

In the present embodiment, a peripheral edge of the nozzle plate 10 of the head 1 is fixed (bonded) to the flange 102*a* of the base 102. The common channel member 70 of the head 1 is fixed to the flange 102*b* of the base 102 in the same way as described in the third embodiment as illustrated in FIG. 6.

The nozzle plate 10 is made of a silicon single-crystal substrate and the base 102 is formed of Invar material. Thus, the head 1 according to the present embodiment can reduce a displacement of relative positions between the nozzles 11 of the nozzle plate 10 of one head 1 with the nozzles 11 of the nozzle plate 10 of another head 1 even when a temperature change or the like occurs.

With such a configuration, the flange 102*a* of the base 102 has a function of a nozzle cover (cover). Thus, the flange 102*a* can reduce contact between the nozzle surface 10*a* of the nozzle plate 10 and a print medium, for example. That is, a part of the base 102 (flange 102*a*) can function as a cover.

Thus, one of the nozzle plate 10 and the individual channel member 60 is bonded to the base 102. For example, the nozzle plate 10 is bonded to the base 102 in FIG. 7, and the individual channel member 60 is bonded to the base 102 in FIGS. 1 through 6.

Figure 8:
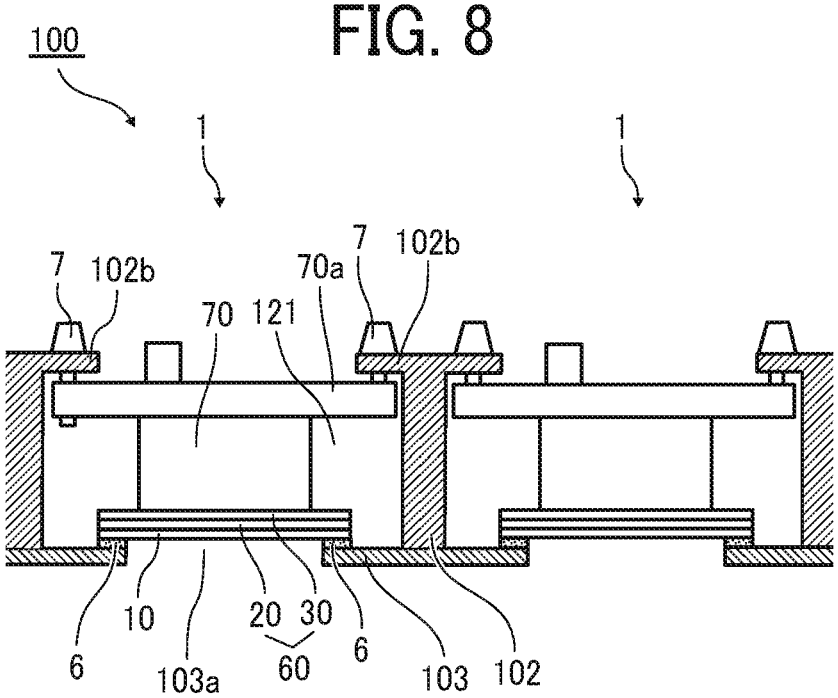
FIG. 8 is a cross-sectional view of a portion of the head module according to a fifth embodiment in the longitudinal direction of the liquid discharge head.

Next, a fifth embodiment of the present disclosure is described with reference to FIG. 8. FIG. 8 is a cross-sectional view of a main portion along a longitudinal direction of the head 1 of the head module 100 according to the fifth embodiment.

In the present embodiment, a cover 103 is bonded to the base 102, and the peripheral edge of the nozzle plate 10 of the head 1 is bonded to the cover 103. The common channel member 70 of the head 1 is fixed to the flange 102*b* of the base 102 in the same way as described in the third embodiment as illustrated in FIG. 6.

The cover 103 is a plate in which an opening 103*a* for exposing the nozzles 11 (see FIG. 10) formed in the nozzle plate 10 is formed. The nozzle plate 10 is made of a silicon single-crystal substrate, and the cover 103 is formed of Invar material.

Thus, as described in the first embodiment, the head 1 according to the present embodiment can reduce a displacement of relative positions between the nozzles 11 of the nozzle plate 10 of one head 1 with the nozzles 11 of the nozzle plate 10 of another head 1 even when a temperature change or the like occurs.

The cover 103 can be manufactured through a rolling process, for example, to reduce a cost of the parts of the cover 103. The cover 103 covering the peripheral edge of the nozzle surface 10*a* is preferably thin to secure a gap between the nozzle surface 11*a* and a printing medium. Bonding the cover 103 of the base 102 to the individual channel plate 20 of the individual channel member 60 makes it easier to narrow the gap.

Figure 9:
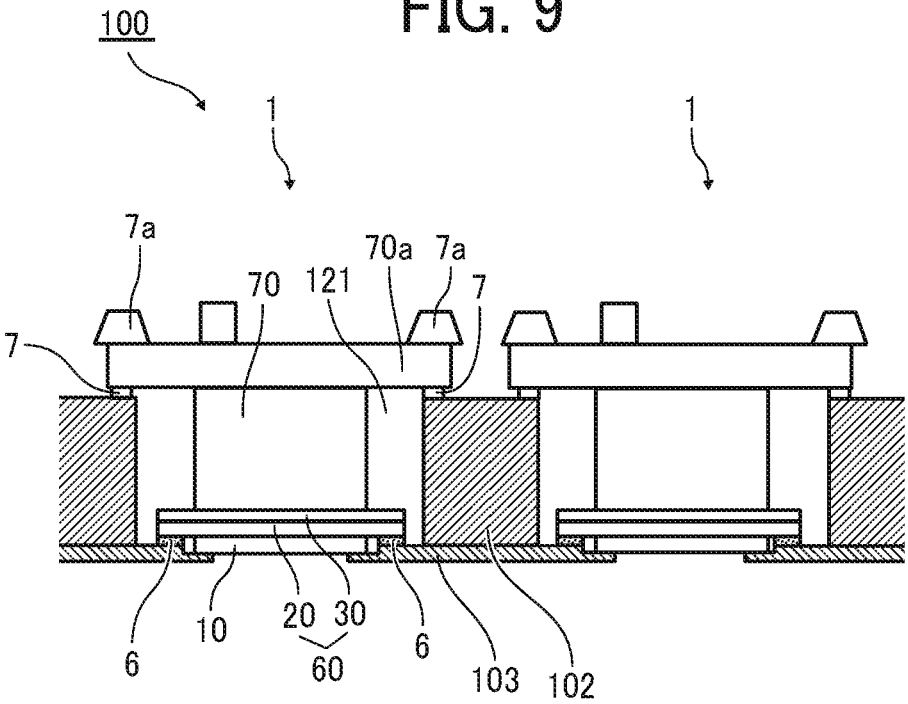
FIG. 9 is a cross-sectional view of a portion of the head module according to a sixth embodiment in the longitudinal direction of the liquid discharge head.

A sixth embodiment according to the present disclosure is described with reference to FIG. 9. FIG. 9 is a cross-sectional view of a main portion along a longitudinal direction of the head 1 of the head module 100 according to the sixth embodiment.

The head 1 of the present embodiment includes the nozzle plate 10, an outer dimension of which is smaller than an outer dimension of the individual channel member 60.

The cover 103 is bonded to the base 102. Further, the peripheral edge of the individual channel member 60 of the head 1 is bonded to the cover 103 bonded to the base 102. The common channel member 70 of the head 1 is fixed to the base 102 by the resin pin 7 in the same way as described in the second embodiment as illustrated in FIG. 4. In the present embodiment, the cover 103 is separate from the base 102. However, the base 102 includes the cover 103 since the cover 103 is bonded to the base 102

The cover 103 is a plate in which an opening 103*a* for exposing the nozzles 11 (see FIG. 10) formed in the nozzle plate 10 is formed. The individual channel member 60 is made of a silicon single-crystal substrate, and the cover 103 is formed of Invar material. The cover 103 and the base 102 are made of the same material.

Thus, as described in the first embodiment, the head 1 according to the present embodiment can reduce a displacement of relative positions between the nozzles 11 of the nozzle plate 10 of one head 1 with the nozzles 11 of the nozzle plate 10 of another head 1 even when a temperature change or the like occurs.

Figure 10:
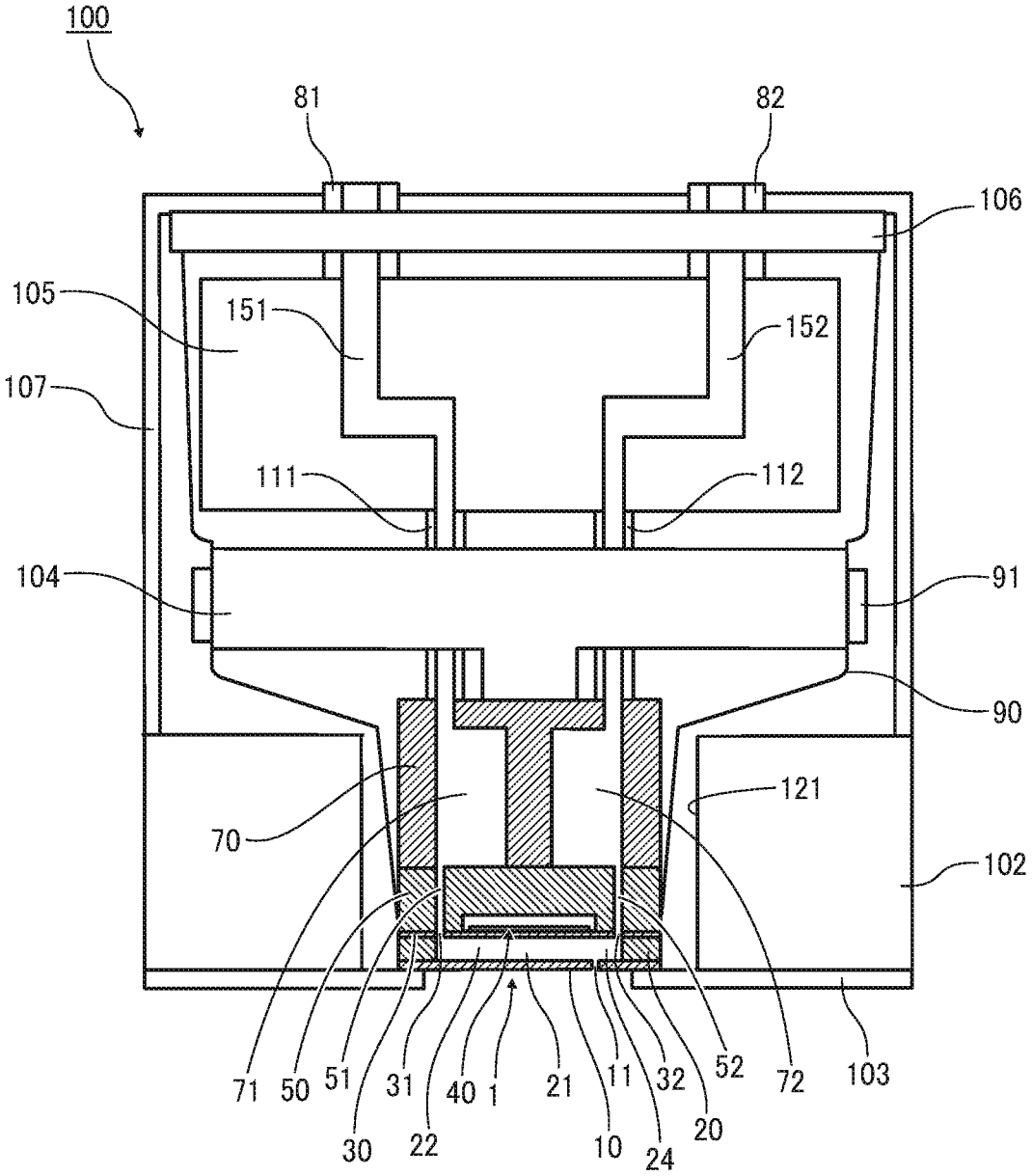
FIG. 10 is a cross-sectional view of a portion of the head module according to a seventh embodiment in the longitudinal direction of a liquid discharge head.
Figure 11:
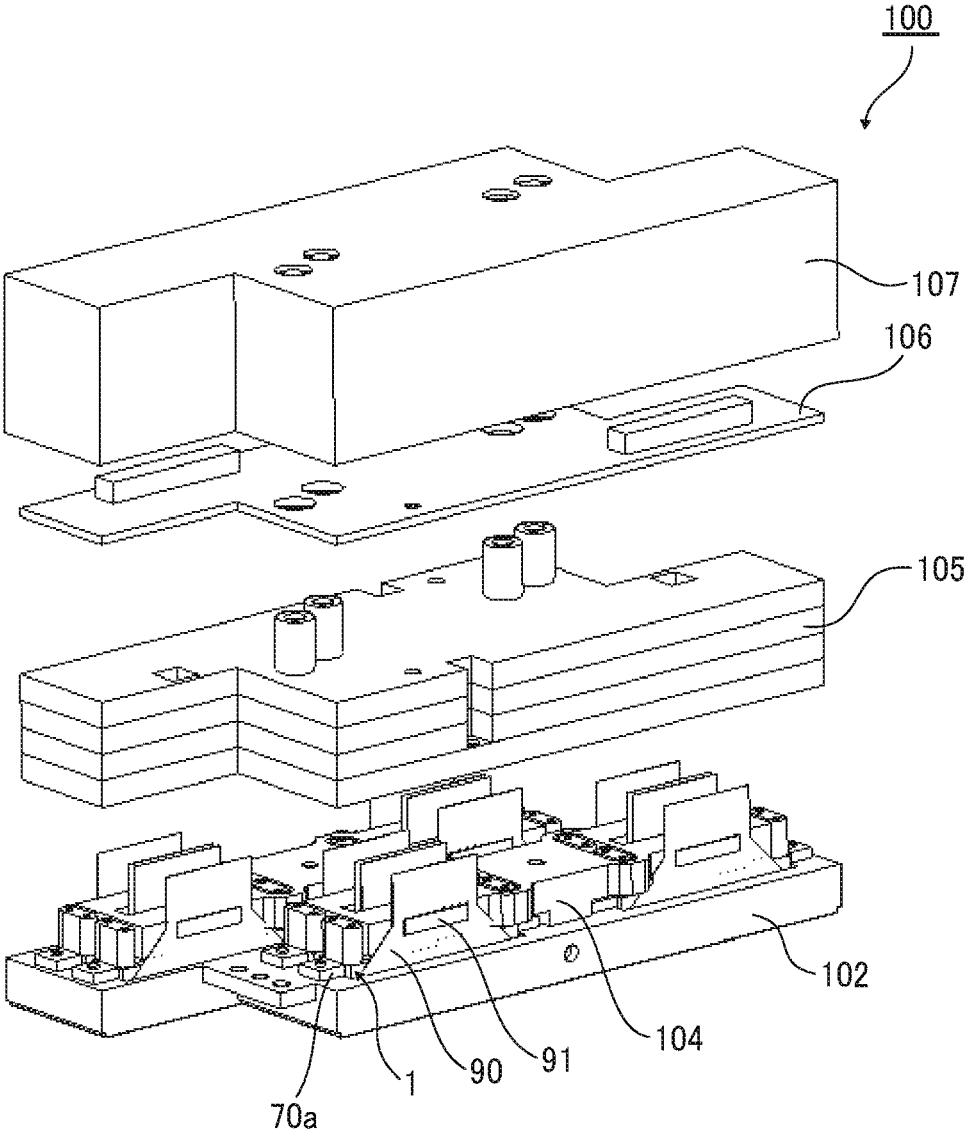
FIG. 11 is an exploded perspective view of the head module.
Figure 12:
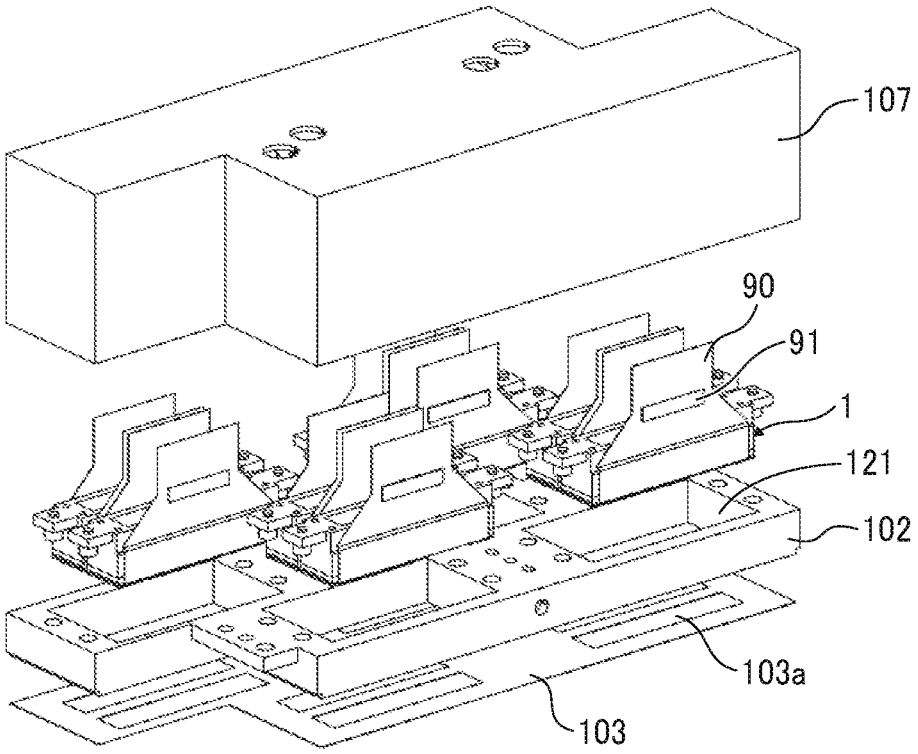
FIG. 12 is an exploded perspective view of a base, the liquid discharge head, and a cover.
Figure 13:
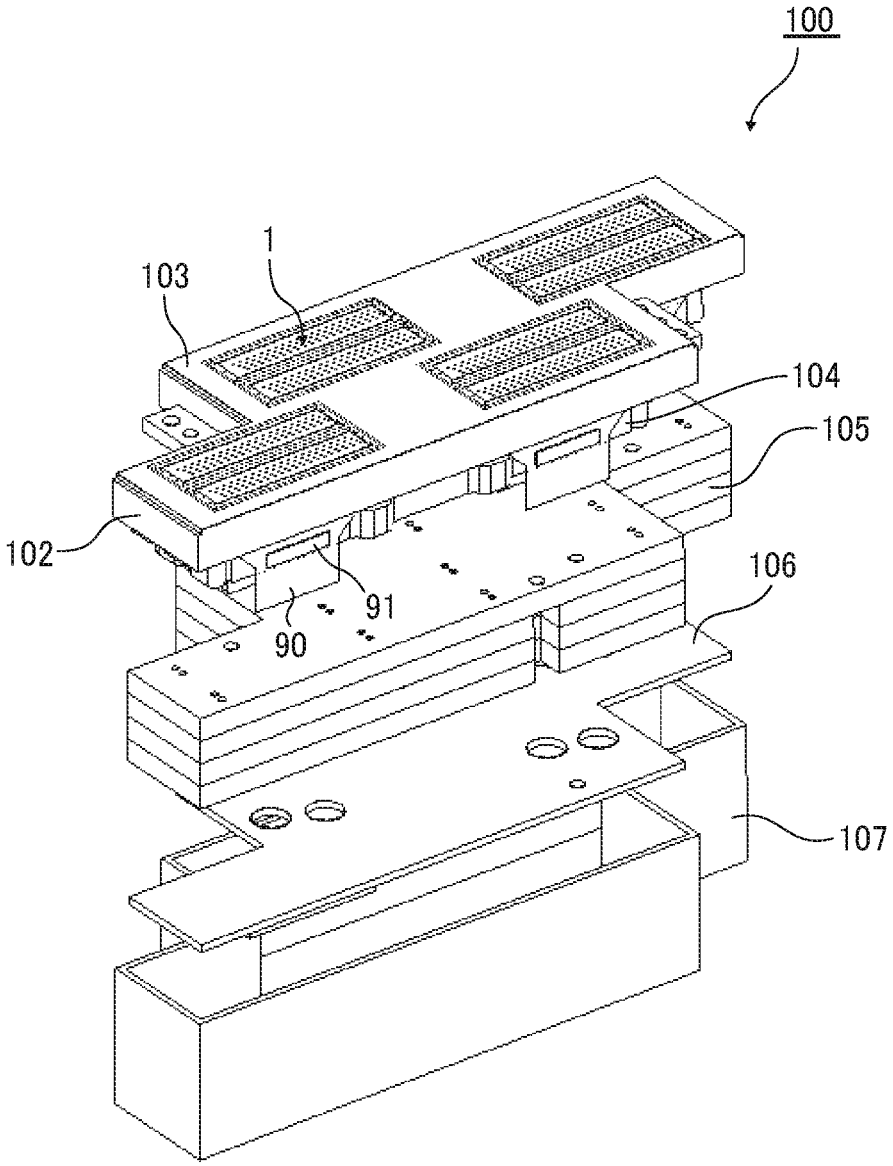
FIG. 13 is an exploded perspective view of the head module viewed from a nozzle surface side of the head module.

Next, a seventh embodiment of the present disclosure is described with reference to FIGS. 10 to 13. FIG. 10 is a cross-sectional view of a portion of a head module 100 according to the seventh embodiment in the transverse direction of the head 1. FIG. 11 is an exploded perspective view of the head module 100. FIG. 12 is an exploded perspective view of the base 102, the head 1, and the cover 103. FIG. 13 is an exploded perspective view of the head module 100 viewed from the nozzle surface 10*a* side of the head module 100.

The head module 100 includes a plurality of heads 1, the base 102, the cover 103, a heat radiator 104, a manifold 105, a printed circuit board 106 (PCB), and a module case 107. The head 1 is configured to discharge a liquid from the nozzles 11.

The plurality of heads 1 includes the nozzle plate 10, the individual channel plate 20, the diaphragm 30, an intermediate channel plate 50, and a common channel member 70, for example. The nozzles 11 are formed in the nozzle plate 10. The individual channel plate 20 forms individual chambers 21 communicating with the nozzles 11, respectively. The diaphragm 30 includes a piezoelectric element 40. The intermediate channel plate 50 is laminated on the diaphragm 30. The common channel member 70 is laminated on the intermediate channel plate 50.

The individual channel plate 20 forms a supply-side individual channel 22 communicating with the individual chamber 21 and a collection-side individual channel 24 communicating with the individual chamber 21 together with the individual chamber 21.

The intermediate channel plate 50 forms a supply-side intermediate individual channel 51 and a collection-side intermediate individual channel 52. The supply-side intermediate individual channel 51 communicates with the supply-side individual channel 22 via an opening 31 of the diaphragm 30. The collection-side intermediate individual channel 52 communicates with the collection-side individual channel 24 via an opening 32 of the diaphragm 30.

The common channel member 70 forms a supply-side common channel 71 and a collection-side common channel 72. The supply-side common channel 71 communicates with the supply-side intermediate individual channel 51. The collection-side common channel 72 communicates with the collection-side intermediate individual channel 52. The supply-side common channel 71 communicates with the supply port 81 via a channel 151 of a manifold 105. The collection-side common channel 72 communicates with the collection port 82 via a channel 152 of the manifold 105.

The supply-side common channel 71 communicates with the channel 151 of the manifold 105 via a supply port 111. The manifold 105 includes a supply port 81 communicating with the channel 151. The collection-side common channel 72 communicates with the channel 152 of the manifold 105 via a collection port 112. The manifold 105 includes a collection port 82 communicating with the channel 152.

The printed circuit board 106 and the piezoelectric element 40 of the head 1 are connected via a flexible wiring 90, and a driver integrated circuits 91 (drive ICs) is mounted on the flexible wiring 90.

In the present embodiment, a plurality of heads 1 are mounted onto the base 102 with a space provided between the heads 1 and the base 102. The head 1 is inserted into the opening 121 in the base 102, and the peripheral edge of the individual channel plate 20 of the head 1 is bonded and fixed to the cover 103 bonded and fixed to the base 102 to attach the head 1 to the base 102. The flange 70*a* provided outside the common channel member 70 of the head 1 is bonded and fixed to the base 102.

A structure of fixing the head 1 to the base 102 is not limited. For example, the head 1 may be fixed to the base 102 with bonding, caulking, screwing, or the like.

Here, the base 102 is preferably formed of a material having a low coefficient of linear expansion. For example, alloy 42 (alloy) with nickel added to iron or invar material may be used for forming the base 102. In the present embodiment, Invar material is used for forming the base 102.

Thus, the head 1 of the present embodiment can reduce a displacement of the nozzles 11 from a predetermined nozzle position to reduce a displacement of a landing position of the liquid discharged from the nozzles 11 of the head 1 even if the head 1 generates heat so that the temperature of the base 102 increases since an amount of a thermal expansion of the base 102 is small.

Similarly, the nozzle plate 10, the individual channel plate 20, and the diaphragm 30 are formed of a silicon single-crystal substrate, and the coefficients of linear expansion of the base 102, the nozzle plate 10, the individual channel plate 20, and the diaphragm 30 are made substantially the same.

Thus, the head 1 of the present embodiment can reduce the displacement of relative positions of the nozzles 11 due to thermal expansion.

Next, a liquid discharge apparatus according to an embodiment of the present disclosure is described with reference to FIGS. 14 and 15.

Figure 14:
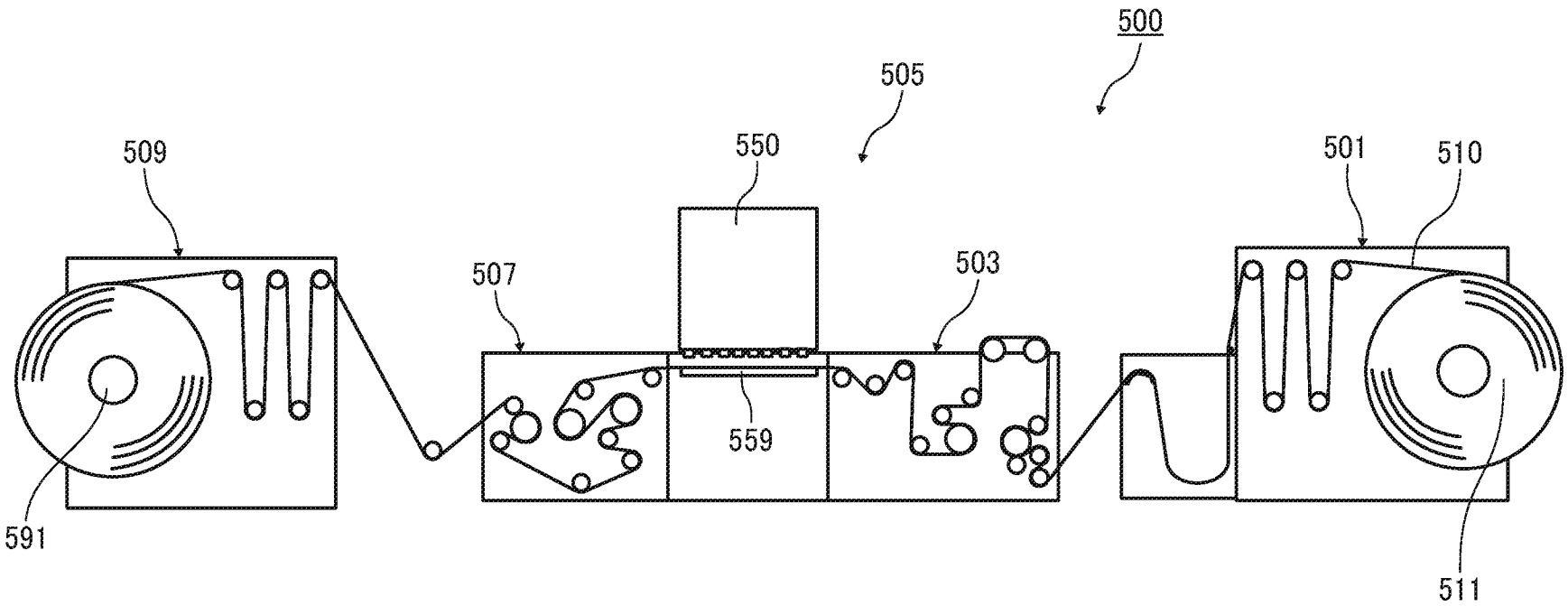
FIG. 14 is a schematic side view of a liquid discharge apparatus according to the present disclosure.

FIG. 14 is a side view of the liquid discharge apparatus according to the present embodiment. FIG. 15 is a plan view of a head unit of the liquid discharge apparatus of FIG. 14 according to the present embodiment.

A printer 500 serving as the liquid discharge apparatus includes a feeder 501 to feed a continuous medium 510, such as a rolled sheet, a guide conveyor 503 to guide and convey the continuous medium 510, fed from the feeder 501, to a printing unit 505, the printing unit 505 to discharge liquid onto the continuous medium 510 to form an image on the continuous medium 510, a drier unit 507 to dry the continuous medium 510, and an ejector 509 to eject the continuous medium 510.

The continuous medium 510 is fed from a root winding roller 511 of the feeder 501, guided and conveyed with rollers of the feeder 501, the guide conveyor 503, the drier unit 507, and the ejector 509, and wound around a winding roller 591 of the ejector 509.

In the printing unit 505, the continuous medium 510 is conveyed opposite a head unit 550 on a conveyance guide 559. The head unit 550 discharges a liquid from the nozzles 11 of the head 1 to form an image on the continuous medium 510.

Figure 15:
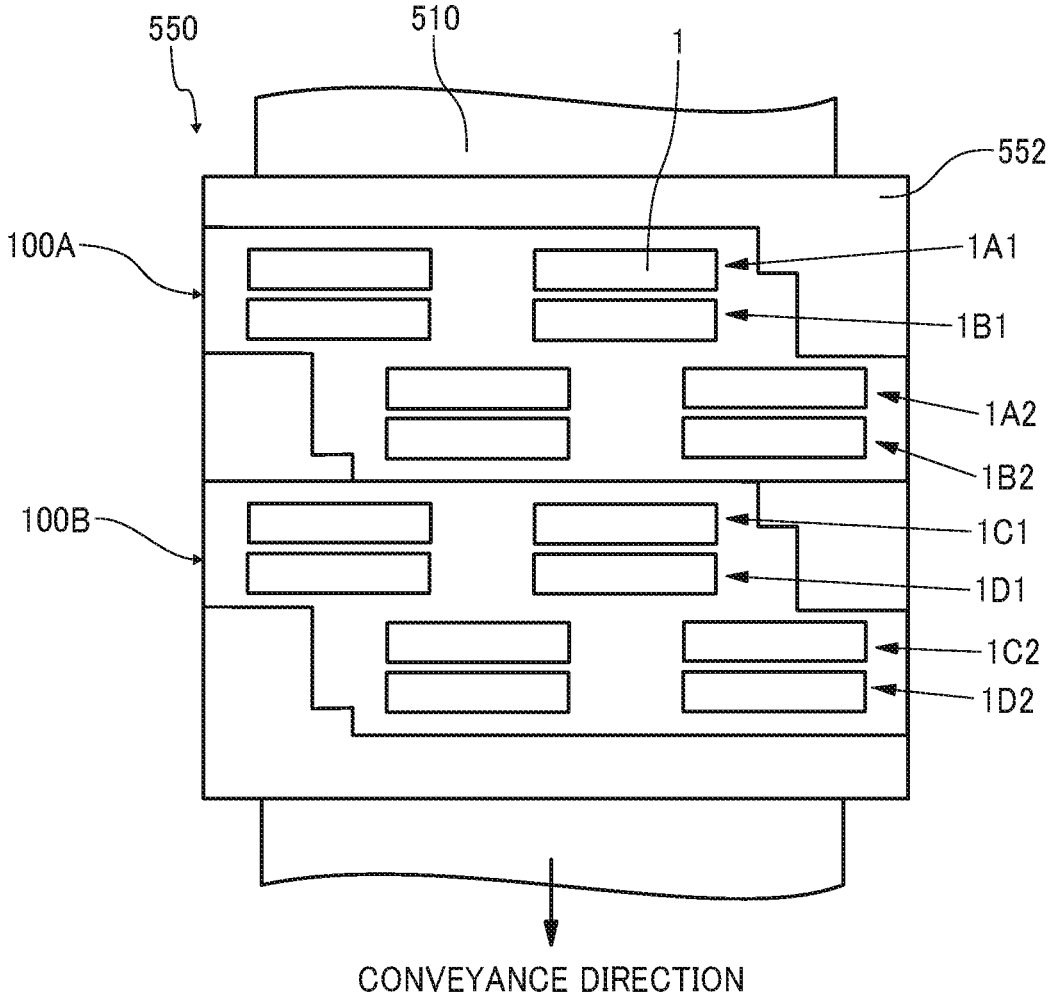
FIG. 15 is a plan view of a head unit of the liquid discharge apparatus of FIG. 14.

Here, as illustrated in FIG. 15, the head unit 550 includes two head modules 100A and 100B according to the present embodiment on a common base 552.

The head module 100A includes head arrays 1A1, 1B1, 1A2, and 1B2. Each of the head arrays 1A1, 1B1, 1A2, and 1B2 includes a plurality of heads 1 arranged in a direction perpendicular to a conveyance direction of the continuous medium 510. The head module 100B includes head arrays 1C1, 1D1, 1C2, and 1D2. Each of the head arrays 1C1, 1D1, 1C2, and 1D2 includes a plurality of heads 1 arranged in a direction perpendicular to a conveyance direction of the continuous medium 510. The head 1 in each of the head arrays 1A1 and 1A2 of the head module 100A discharges liquid of the same color. Similarly, the head arrays 1B1 and 1B2 of the head module 100A are grouped as one set that discharge liquid of the same color. The head arrays 1C1 and 1C2 of the head module 100B are grouped as one set that discharge liquid of the same color. The head arrays 1D1 and 1D2 are grouped as one set to discharge liquid of the same color.

The head module 100 according to the present embodiment can be formed together with functional parts and mechanisms as a single unit (integrated unit) to constitute a liquid discharge device. For example, at least one of the configurations of the head module 100, a head tank, a carriage, a supply mechanism, a maintenance unit, a main scan moving unit, and the liquid circulation device may be combined together to form the liquid discharge device.

Examples of the "single unit" include a combination in which the head module 100 and one or more functional parts and devices are secured to each other through, e.g., fastening, bonding, or engaging, and a combination in which one of the head module 100 and the functional parts and devices is movably held by another. Further, the head module 100, the functional parts, and the mechanism may be configured to be detachable from each other.

The term "liquid discharge apparatus" used herein is an apparatus including the head module 100 or a liquid discharge device to drive the head 1 to discharge liquid. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

The above-mentioned "material onto which liquid can be adhered" may be any material as long as liquid can temporarily adhere such as paper, thread, fiber, cloth, leather, metal, plastic, glass, wood, ceramics, or the like.

The "liquid discharge apparatus" may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

Liquid to be discharged from the nozzles of the liquid discharge head is not limited to a particular liquid as long as the liquid has a viscosity or surface tension to be discharged from the liquid discharge head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, suspension, or emulsion can be, e.g., inkjet ink, surface treatment solution, a liquid for forming components of electronic elements or light-emitting elements or a resist pattern of an electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element such as a heating resistor, and an electrostatic actuator including a diaphragm and opposed electrodes.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A head module comprising:

a base including a plurality of openings; and a plurality of heads inserted into the plurality of openings, respectively, to be mounted on the base, the plurality of heads including, a nozzle plate including a nozzle;

an individual channel member disposed on the nozzle plate and including an individual chamber communicating with the nozzle, the individual channel member being bonded to the base; and a frame fixed to the individual channel member, wherein coefficients of linear expansion of the nozzle plate and the individual channel member are substantially identical to a coefficient of linear expansion of the base.

2. The head module according to claim 1, wherein a peripheral edge of the nozzle plate is bonded to the base.

3. The head module according to claim 2, wherein the base includes a cover that covers the peripheral edge of the nozzle plate, and the peripheral edge of the nozzle plate is bonded to the cover.

4. The head module according to claim 1, wherein the individual channel member facing the frame is bonded to the base.

5. The head module according to claim 1, wherein the frame and the base have different coefficients of linear expansion, and the frame is bonded to the base.

6. The head module according to claim 1, further comprising a pin having a shaft to crimp the frame to the base.

7. The head module according to claim 6, wherein the frame is relatively movable against the base by a gap between sides of a hole in the base and the shaft of the pin when the pin is inserted through the hole in the base.

8. The head module according to claim 1, wherein the base includes a cover to cover a peripheral edge of the nozzle plate; and a peripheral edge of the individual channel member is bonded to the cover.

9. The head module according to claim 1, wherein the nozzle plate and the individual channel member are formed of a silicon single-crystal substrate, and the base is formed of alloy 42 or Invar.

10. The head module according to claim 9, wherein the frame is formed of a thermoplastic resin.

11. The head module according to claim 1, wherein the plurality of heads is configured to discharge a liquid from the nozzle.

12. A liquid discharge apparatus comprising;

the head module according to claim 11.

13. The head module according to claim 1, wherein both the individual channel member and the frame are bonded to the base.

14. A head module comprising:

a base including a plurality of openings; and a plurality of heads inserted into the plurality of openings, respectively, to be mounted on the base, the plurality of heads including, a nozzle plate including a nozzle;

an individual channel member disposed on the nozzle plate and including an individual chamber communicating with the nozzle; and a frame fixed to the individual channel member, wherein coefficients of linear expansion of the nozzle plate and the individual channel member are substantially identical to a coefficient of linear expansion of the base, and one of the nozzle plate and the individual channel member is bonded to the base, and wherein a coefficient of linear expansion of the frame is different from the coefficient of linear expansion of the base, and the frame is bonded to the base.

* * * * *